United States Patent [19]

Furiate

[11] Patent Number: 4,515,499

[45] Date of Patent: May 7, 1985

[54] TRAFFIC LANE DELINEATOR

[76] Inventor: David L. Furiate, 7805 Marion Twp., Rd. #237, Findlay, Ohio 45840

[21] Appl. No.: 486,359

[22] Filed: Apr. 19, 1983

[51] Int. Cl.[3] ..... E01F 15/00

[52] U.S. Cl. ..... 404/6; 404/10; 404/15; 116/63 R

[58] Field of Search ..... 404/6, 10, 9, 11, 12, 404/13, 14, 15, 16; 350/107; 116/63 R, 63 P; 40/608

[56] References Cited

U.S. PATENT DOCUMENTS

| | | | |
|---|---|---|---|
| 2,145,936 | 2/1939 | Landeen | 404/12 |
| 2,774,323 | 12/1956 | Kirk | 116/63 R |
| 2,826,128 | 3/1958 | Summers | 404/12 |
| 2,826,393 | 3/1958 | Miller | 404/13 X |
| 3,212,415 | 10/1965 | Byrd | 404/10 |
| 3,334,554 | 8/1967 | Adams | 116/63 P |
| 3,485,201 | 12/1969 | Kelley | 404/10 |
| 3,807,699 | 4/1974 | France | 404/6 X |
| 4,080,085 | 3/1978 | Dickson | 404/14 |
| 4,240,766 | 12/1980 | Smith et al. | 404/10 |
| 4,249,832 | 2/1981 | Schmanski | 404/9 X |
| 4,373,464 | 2/1983 | Blau | 404/10 X |

FOREIGN PATENT DOCUMENTS

| | | | |
|---|---|---|---|
| 482604 | 5/1976 | Australia | 404/6 |
| 638429 | 3/1962 | Canada | 404/9 |
| 756350 | 4/1967 | Canada | 404/9 |
| 2457928 | 1/1981 | France | 404/6 |
| 284021 | 7/1952 | Italy | 116/63 P |
| 626097 | 10/1961 | Italy | 404/10 |
| 2036140 | 6/1980 | United Kingdom | 404/15 |

*Primary Examiner*—James A. Leppink
*Assistant Examiner*—Beverly E. Hjorth
*Attorney, Agent, or Firm*—David D. Murray

[57] ABSTRACT

A traffic lane delineator includes an elongate centrally disposed planar strip flanked on at least one side, and generally both sides, by outwardly extending tabs or ribs. The width of each rib may be equal to the space between adjacent ribs or the rib width and spacing therebetween may be varied if desired. This configuration provides an audible warning if a moving vehicle engages and drives upon the ribs. The planar strip preferably also includes a longitudinally extending double yellow line marking which may include reflective material. A physical barrier along the central strip may take the form of spaced-apart stanchions which may include reflective material for visibly delineating the traffic lanes. The delineator may be readily installed on a lane surface as needed as well as removed and rolled or stacked for compact storage.

13 Claims, 11 Drawing Figures

FIG. 1
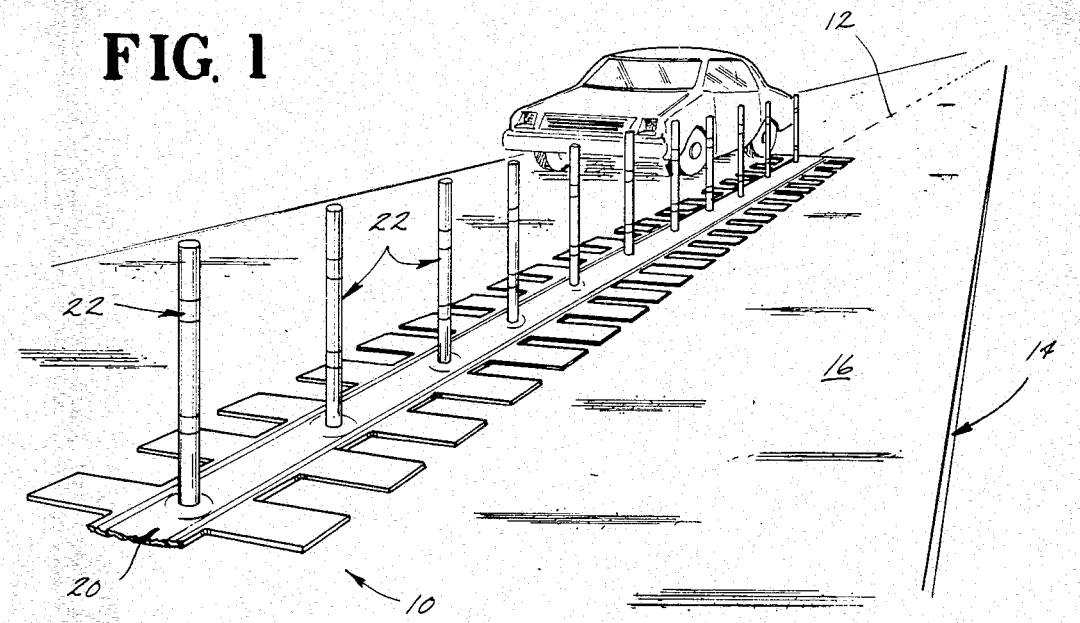
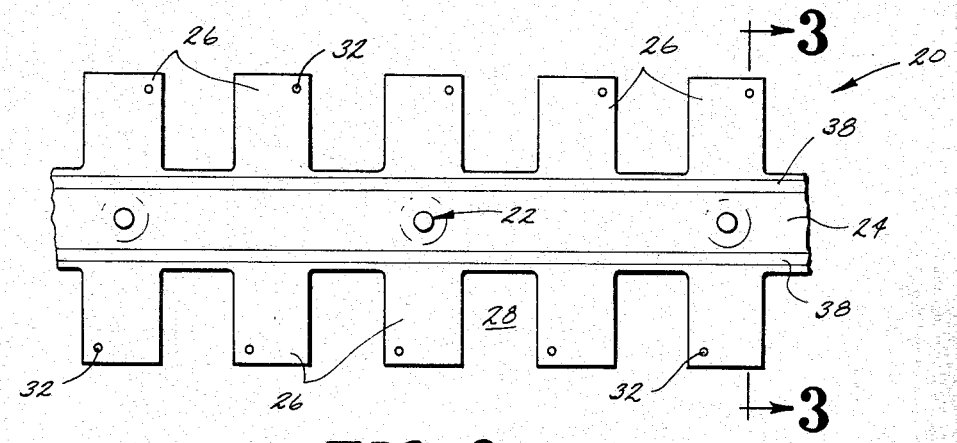
FIG. 2
FIG. 3
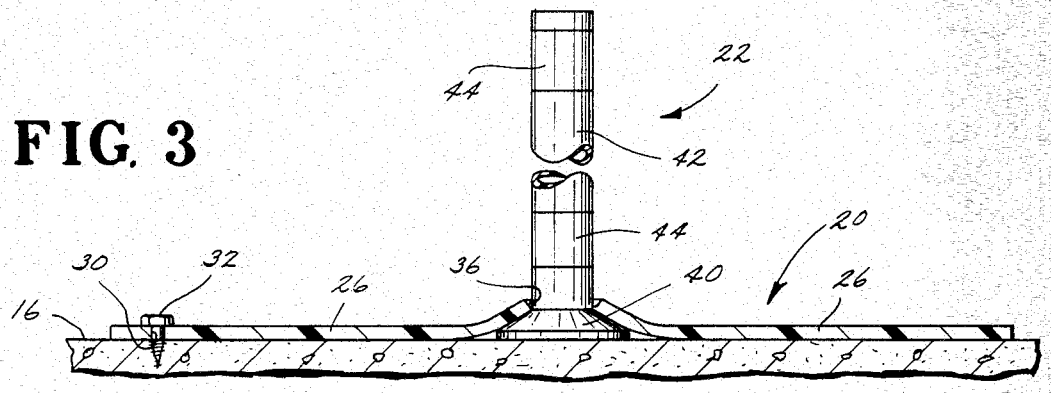

TRAFFIC LANE DELINEATOR

BACKGROUND OF THE INVENTION

The invention relates generally to roadway and motor vehicle pathway markers and more particularly to a readily installed and removed motor vehicle lane delineator which clearly marks the center line between adjacent lanes of traffic or outside edge of a lane as well as providing an audible warning when a motor vehicle drives thereupon.

An ongoing concern of drivers, road designers and those associated with transportation safety relates to the reduction of motor vehicle accidents. Substantial government and private sector money has been expended on research projects directed to improving, for example, road surface traction, lane marking visibility and traffic light and highway sign clarity. Given both the high mobility of the American public as well as the losses resulting from motor vehicle accidents, research in these areas continues.

Not all monies devoted to improving the safety of the nation's highways are, however, expended in research. Substantial expenditures are made each year for road resurfacing, safety upgrading, structural rebuilding, widening, and similar improvements. Because of the necessity of maintaining traffic flow, these improvements can typically be effected only to one portion or lane of a road at time. Such traffic is, however, frequently directed across a median strip or other divider and onto one or more of the lanes of the opposing flow of traffic which have been designated for this purpose. Such a traffic flow arrangement, i.e., opposing traffic flows in adjacent lanes intended for unidirectional traffic flow, is not altogether benign, and may, in fact, be a significant contributing factor to an accident. Unfortunately, such an accident may be serious in that it will tend to involve vehicles which are traveling and collide substantially head on.

Such construction sites, however, are but one of many hazardous or potentially hazardous traffic areas. Structures such as bridges and tunnels, particularly those built before the now presently standardized twelve foot lane width, represent other areas having a higher than average accident potential.

Aside from actual highway situations, it is frequently desirable to utilize traffic flow dividers adjacent the entrance of tunnels, in association with toll booths and in parking lots and parking structures. In such situations, not only can accidents of a lesser nature be avoided but also traffic flow in both diverging and converging lanes can be improved.

A review of the prior art reveals various apparatus for traffic lane demarcation and safety enhancement. For example, U.S. Pat. No. 3,212,415 discloses a free standing pole for lane marking. U.S. Pat. No. 2,457,512 discloses an audible and physically sensible warning device which may be embedded in highway pavement. U.S. Pat. No. 3,587,415 illustrates an elongate strip having reflective markers which is intended to be placed on the surface of the road between lanes of opposing traffic. U.S. Pat. No. 4,004,857 teaches a movable barrier which is disposed parallel to the flow of traffic but which may be moved transversely between such lanes to selectively mark, for example, reversible traffic lanes. U.S. Pat. No. 2,221,357 teaches a lane marking device having as its primary feature portability. None of the above devices, however, combine what are believed to be the necessary features such as portability, visibility and audibility.

SUMMARY OF THE INVENTION

A traffic lane delineator according to the instant invention includes means which are both highly visible to the driver of a motor vehicle and provide positive audible and physically sensible warning signals to the driver of a vehicle that he has driven close to the edge of a lane and/or the adjacent lane of traffic. These features are provided in a device which is readily disposed at a given site, may be equally as readily removed, but which is constructed of materials having a long life and is therefore suitable for permanent installation as well.

The traffic lane delineator includes a central, elongate, planar strip which preferably extends the full length of the traffic zone to be marked. Obviously, the planar strip may be utilized in lengths of, for example, 20, 50, or 100 feet to facilitate handling. On at least one and generally both edges of the central, planar strip are disposed outwardly extending ribs or tabs. The ribs and central, planar strip may be removably secured to the roadway by suitable fasteners. The outwardly extending ribs or tabs are spaced apart a distance approximately equal to or at least as great as the width of each of the ribs. More specifically, the rib spacing and rib width should be great enough to cause a typical vehicle tire to lift fully off the pavement and return to the pavement between adjacent ribs such that the tire is alternately raised off the pavement the height of the material and dropped or returned to the pavement surface between such ribs. In this manner, the vehicle tires produce a clearly audible sound and physically sensible vibration is transmitted through the steering linkage and other vehicle components to the driver. The edges of the ribs facing each lane of traffic may include reflectorized material to further demarcate the edge of a traffic lane and may be disposed at an angle. Disposed at intervals along the central strip are a plurality of stanchions which visibly mark the center line of the roadway. The stanchions are inserted through suitably sized openings in the planar strip and are maintained in an upright orientation by cooperation between the strip and a flanged base structure. The stanchions may, and preferably are, painted a bright, highly visible color and may include reflective material to further increase their visibility at night.

Thus it is an object of the instant invention to provide a traffic lane delineator which provides both a highly visible, audible, and physically sensible warning to drivers.

It is a further object of the instant invention to provide a traffic lane delineator which may be readily installed and removed from a highway.

It is a still further object of the instant invention to provide a traffic lane delineator which is fabricated of rugged and strong material which may be utilized for permanent as well as temporary service.

It is a still further object of the instant invention to provide a traffic lane delineator including reflective material to improve visibility thereof at night.

It is a still further object of the instant invention to provide an improved traffic lane delineator for use on highways and other congested traffic areas such as parking structures, tunnels, toll plazas, traffic ramps and the like.

Further objects and advantages of the instant invention will become apparent by reference to the following description of the preferred embodiment and appended drawings.

BRIEF DESCRIPTION OF THE DRAWINGS

FIG. 1 is a perspective view of a traffic lane delineator in place upon a two lane road carrying single lanes of traffic in opposite directions;

FIG. 2 is a fragmentary, top plane view of a traffic lane delineator according to the instant invention;

FIG. 3 is a fragmentary, sectional view of a traffic lane delineator taken along line 3—3 of FIG. 2;

DESCRIPTION OF THE PREFERRED EMBODIMENT

Figure 4:
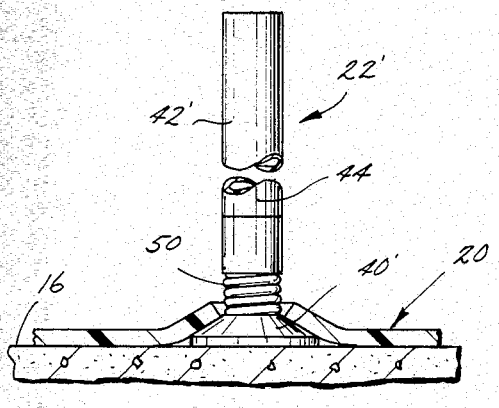
FIG. 4 is a fragmentary, sectional view of a first alternate embodiment of the stanchion illustrated in FIG. 3.

Referring now to FIG. 1, a traffic lane delineator according to the instant invention is illustrated and generally designated by the reference numeral 10. The lane delineator 10 is preferably positioned directly on and along a demarcation or center line 12 defining the boundary between adjacent lanes of traffic on a highway 14. Additionally, the lane delineator 10 may be utilized to identify either or both outer edges of a single traffic lane, such as the lane 16, to separate parallel lanes of unidirectional traffic, or for any other purpose in which a clear indication of the transverse limits of vehicle position on a roadway, traffic lane, bridge approach, ramp or other surface is desired. The lane delineator 10 includes an elongate planar surface assembly 20 and a plurality of vertically disposed stanchion assemblies 22.

Referring now to FIGS. 2 and 3, the surface assembly 20 is seen to include a continuous elongate central portion 24 flanked on at least one and preferably both sides by outwardly extending ribs or tabs 26. The tabs 26 may be laterally aligned as illustrated in FIG. 2, alternately aligned or disposed on left and right sides of the center portion 24 in any desired relative arrangement. Between adjacent tabs 26 is a void or open region 28. Adjacent each corner of the tabs 26 formed by the intersection of the leading edge of the tab, e.g., that edge engaged by on coming traffic and the outermost edge, is disposed a through aperture 30 which receives a fastener 32 such as a lag screw, masonry nail or similar device for securing the tabs 26 and generally, the entire surface assembly 20 to the highway 14. Disposed medially along the central portion 24 are disposed a plurality of spaced-apart apertures 36 through which the stanchion assemblies 22 extend. Preferably, the surface assembly 20 also includes a pair of parallel lines 38 such as painted yellow lines along the upper surface of the central portion 24 which embody the standard highway sign convention of a no passing zone. The lines 38 may include reflecting material such as glass beads to further improve their visibility, particularly at night and in inclement weather.

Construction details of the surface assembly 20 are as follows. Preferably, the surface assembly is fabricated of a durable elastomeric material such as rubber and is of a grade generally utilized for conveyor belting and the like. Such material having a thickness of approximately one inch has been found to provide both suitable durability and the appropriate audible warning as will be more fully described subsequently. However, material thickness substantially greater or less than one inch may be also employed. The width of the material is preferably about four feet, the central portion 24 and each of the left and right tabs 26 occupying approximately sixteen inches of the total width. It should be readily appreciated, however, that the total width as well as the width occupied by the central section 24 and tabs 26 may be adjusted over relatively wide ranges to accommodate particular applications. Similarly, the longitudinal dimension of each of the tabs as well as the dimension of the open region 28 between adjacent tabs may be adjusted to suit particular requirements. A width of approximately one foot for both the tabs 26 and open regions 28 has been found to provide a good audible warning since such a width substantially ensures that the tires of a vehicle will be lifted fully off the pavement during the time the tires are on top of the tab 26 and returned fully to the pavement as the tires traverse the adjacent open region 28. Aside from considering the harmonic resonance of suspension systems, this vertical oscillation mode of the tires will thus provide the maximum audible signal for any given thickness of the tabs 26. It will be readily appreciated that smaller tab widths and open region dimensions will increase the perceived frequency of sound generated by vehicles passing thereover and vice versa. From an installation and service standpoint, however, reduced width of the tabs 26 and open regions 28 is disadvantageous. It can thus be appreciated that a precise width of the tabs 26 and the width of the open regions 28 is primarily a matter of design choice and that variations in these dimensions and relations from those described above and illustrated in the drawings are considered to be within the scope of this invention.

Referring again to FIG. 3, the stanchion assembly 22 includes a generally frusto-conical base portion 40. The dimensions of the frusto-conical base portion 40 are not critical but it should be sufficiently large to positively prevent passage of it through the opening 36 in the surface assembly 20 and generally maintain the stanchion assembly 22 in a vertical position in spite of contact by motor vehicles. A diameter of between five and ten inches has been found wholly suitable. The stanchion assembly 22 includes a post or upright, cylindrical member 42 secured to the base portion 40 by any conventional means and fabricated of a durable material such as natural or synthetic rubber. The cylindrical member 42 may be generally of the structure and nature of a rubber hose or may be fabricated of other material such as polyethylene, polyvinylchloride or polyurethane. The cylindrical member 42 is preferably a bright color such as orange, yellow or red. The stanchion assembly 22 may also include a plurality of bands 44 of white reflective material disposed at one or more locations along the member 42.

Figure 3A:
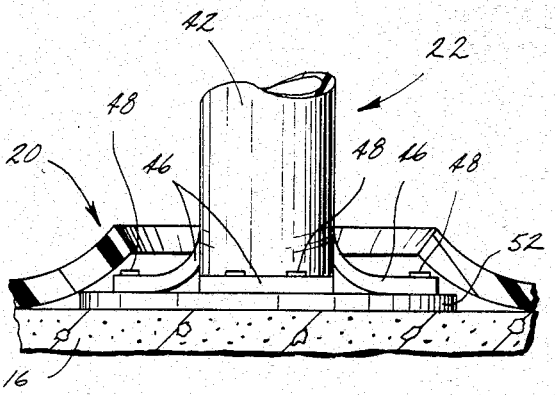
FIG. 3A is an enlarged fragmentary view of a variation of the stanchion illustrated in FIG. 3.

Referring briefly to FIG. 3A, a specific scheme which flexibly secures the cylindrical member 42 of the stanchion assembly 22 to a planar base 52 is illusrated. Here, the member 42 is axially cut at one end to form a plurality of tabs 46. The tabs 46 are secured to the base section 40 by fasteners 48 such as rivets or nuts and bolts.

Referring now to FIG. 4, a first alternate embodiment 22' of the stanchion assembly 22 is illustrated. The stanchion assembly 22' is generally similar to the preferred embodiment stanchion assembly 22. It thus includes a frusto-conical base section 40' and cylindrical member 42' which may include reflective bands 44, if desired, like those utilized in the preferred embodiment stanchion assembly 22. Coupling the frusto-conical base section 40' with the cylindrical member 42' is a resilient spring 50. The spring 50 provides a flexible interconnection between the two components just delineated and thereby improves the serviceability and life of the stanchion assembly 22'. The spring 50 both permits great angular displacement of the member 42' relative to the base section 40' as might occur when a vehicle drives directly over the stanchion assembly 22' and, after such incident, restores the member 42' to its upright position as illustrated.

Figure 5:
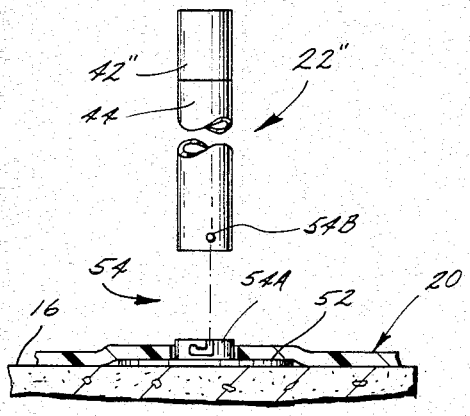
FIG. 5 is a fragmentary, sectional view of a second alternate embodiment of the stanchion illustrated in FIG. 3.

Referring now to FIG. 5, a second alternate embodiment 22'' of the stanchion assembly 22 is illustrated. Again, the second alternate embodiment stanchion assembly 22'' is generally similar to the preferred embodiment stanchion assembly 22. It includes a generally planar base 52 which may be permanently secured to the surface assembly 20 by rivets or other suitable fastening means (not illustrated). The base 52 includes a portion of a bayonet assembly 54, for example, a socket 54A secured thereto. The second alternate embodiment stanchion assembly 22'' also includes an upright cylindrical member 42'' which may include the reflective bands 44. At the lower portion thereof is disposed a bayonet portion 54B of the bayonet assembly 54. The bayonet assembly 54 is conventional and thus includes a compressive device (not illustrated) within either the base assembly 52 or member 42'' which maintains the bayonet assembly 54 in an interlocked position and the base 52 and member 42'' interconnected according to conventional practice. It will be appreciated that the second alternate embodiment stanchion assembly 22'' facilitates installation and removal of the lane delineator 10 since the base 52 is preferably secured directly to the surface assembly 20. Thus, subsequent to the deployment of the surface assembly 20, the cylindrical members 42'' may be readily secured to respective bases 52 by means of the bayonet assemblies 54. It should be understood that the bayonet assembly 54 of the second alternate embodiment stanchion assembly 22'' may be utilized in conjunction with the spring 50 of the first alternate embodiment stanchion assembly 22' if desired.

Figure 6:
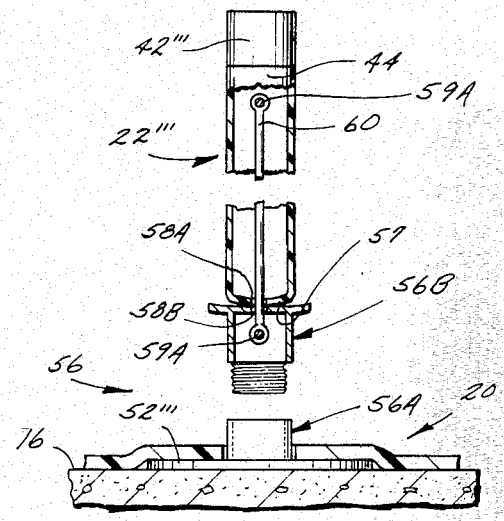
FIG. 6 is an elevational view in partial section of a third alternate embodiment of the stanchion illustrated in FIG. 3.

Referring now to FIG. 6, a third alternate embodiment 33''' of the stanchion assembly 22 is illustrated. Here, too, the third alternate embodiment stanchion assembly 22''' is generally similar to the preferred embodiment stanchion assembly 22 though it includes features of both the first alternate embodiment stanchion assembly 22' and the second alternate embodiment stanchion assembly 22'' as will be apparent from the following description. The stanchion assembly 22''' includes a generally planar base 52''' which may be permanently secured to the surface assembly 20 by rivets or other suitable fastening means (not illustrated). The base 52''' includes one interengaging component of a threaded assembly 56, for example, a collar 56A having female threads disposed therein. The complementary portion of the threaded assembly 56 is a plug 56B having male threads which seat within the female threads of the collar 56A. The third alternate embodiment stanchion assembly 22''' also includes an upright cylindrical member 42''' having a substantially planar bottom portion 57 which defines a central aperture 58A. The stanchion assembly 22''' may likewise include reflective bands 44. Aligned with the opening 58A is a second similarly sized opening 58B in the top of the plug 56B. Extending between a first pin 59A disposed centrally and transversely in the member 42''' and a second pin 59B disposed centrally and transversely within the plug 56B is an elastic band 60. The elastic band 60 which may be fabricated of rubber or other similarly resilient structure such as a coil spring, provides a self righting force to the cylindrical member 42''' should its vertical orientation be disturbed by a motor vehicle. It will thus be appreciated that the third alternate embodiment stanchion assembly 22''' incorporates both the resilient feature of the first alternate embodiment stanchion assembly 22' and the demountable feature of the second alternate embodiment stanchion assembly 22''.

Figure 7:
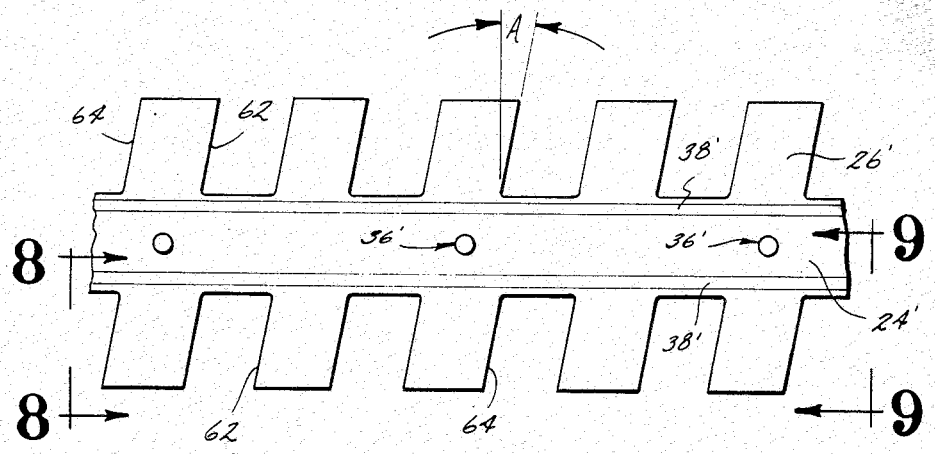
FIG. 7 is a fragmentary, top plan view of an alternate embodiment of a portion of the traffic lane delineator according to the instant invention.

Referring now to FIG. 7, an alternate embodiment 20' of the surface assembly 20 is illustrated. The alternate embodiment surface assembly 20 generally includes an elongate central portion 24' and ribs or tabs 26' and is generally similar to the preferred embodiment surface assembly 20. It thus includes a pair of parallel lines 38 which may be yellow in color and include reflective material. The tabs 26' include leading edges 62 and trailing edges 64 which are disposed at a small acute angle A of between about 5° and 20° to the transverse axis of the lane delineator 10. An angle A of about 8° has been found to be preferable. Disposed in this fashion, the leading edges 62 of the tabs 26' tend to redirect the wheels of a vehicle driving thereover away from the lane delineator 10 and into the proper traffic lane.

Figure 8:
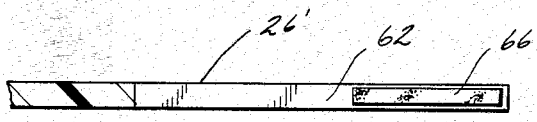
FIG. 8 is a fragmentary, elevational view of the alternate embodiment of the portion of the traffic lane delineator taken along line 8—8 of FIG. 7.

Referring now to FIGS. 7 and 8, the leading edges 62 of the tabs 26' may also include a region of reflective material 66. The reflective material 66 is yellow in color and provides a further visible indication of the edge of the traffic lane and significantly improves visibility thereof at night and during other times of reduced visibility. The trailing edges 64 likewise include reflective material 68 which is red in color and is visible from the opposing lane of traffic. It should be understood that either the angularly disposed leading edges 62 and trailing edges 64 of the tabs 26' or the inclusion of reflective material 66 may be utilized singly or together and that the use of the reflective material 64 may be readily included as a portion of the structure of the preferred embodiment 20 illustrated in FIGS. 1 and 2.

Figure 9:
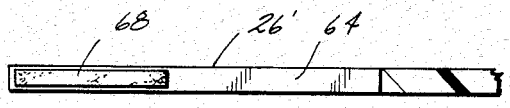
FIG. 9 is a fragmentary, elevational view of the alternate embodiment of the portion of the traffic lane delineator taken along line 9—9 of FIG. 7.

Referring now to FIGS. 7 and 9, the trailing edges 64 of the tabs 26' preferably also include a region of relective material 68. The reflective material 68 is red in color and provides an indication to a motorist of the general location of the proximate edge of the oncoming traffic lane. Again it should be understood that the red reflective material may be utilized singly or with the yellow reflective material 66 on either the preferred embodiment surface assembly 20 or the alternate embodiment surface assembly 20'.

Figure 10:
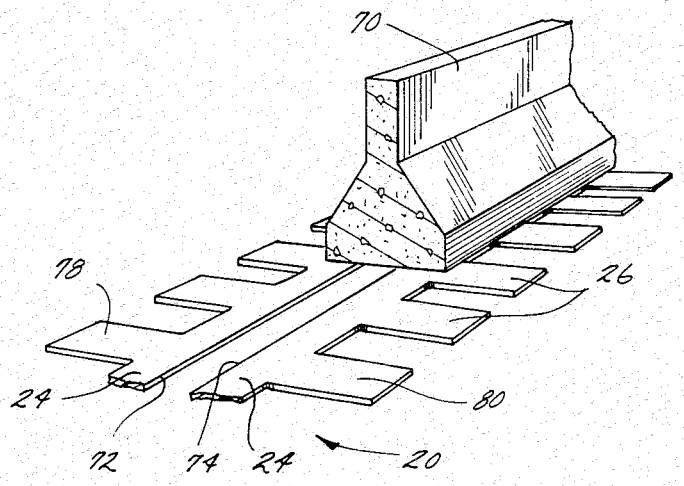
FIG. 10 is a perspective view of an alternate embodiment of the traffic lane delineator according to the instant invention having a safety barrier disposed thereon.

Referring now to FIG. 10, an alternate embodiment of the lane delineator 10 of the instant invention is illustrated. In the alternate embodiment lane delineator 10', either the preferred embodiment of the surface assembly 20 or the alternate embodiment of the surface assembly 20' is utilized in conjunction with sections of solid concrete safety dividers 70. In this configuration, the surface assembly 20 or 20' may be split longitudinally along its center line, forming opposed edges 72 and 74 and left and right halves 78 and 80. The halves 78 and 80 of the surface assembly 20 or 20' may thus be transversely positioned relative to the safety divider 70 in order that they extend outwardly therefrom a suitable, efficacious distance. The surface assembly 20 or 20' provides an audible warning of the lateral movement of a vehicle into close proximity with the opposing lane of traffic and the safety divider 70. Thus it will be appreciated that the function of the lane delineator 10' illustrated in FIG. 8 is similar to that illustrated in FIG. 1, providing both visual and audible information regarding the demarcation line between adjacent traffic lanes, and that it further provides a more significant structural barrier to lateral traverse by vehicles. It will also be appreciated that the halves 78 and 80 of the surface assembly 20 may be used individually to mark the edge of a traffic lane not adjacent a traffic lane, as for example on a bridge, narrow road and the like. Each of the halves 78 and 80 may, of course, include a bright, visible line such as the painted lines 38 shown in FIG. 2.

Installation of the traffic lane delineator 10 and its various alternate embodiments is straightforward. Lengths of the surface assembly 20 are generally positioned longitudinally along the highway 14. In the preferred embodiment of the delineator 10, the stanchion assemblies 22 are then inserted through the apertures 36 from the bottom side of the surface assembly 20 and then the surface assembly 20 and stanchion assemblies 22 are aligned along the center line 12, edge, or other position on the highway 14. The surface assembly 20 and thus indirectly the stanchion assemblies 22 are then secured to the highway 14 by installing a plurality of fasteners 32 through the apertures 30 in the tabs 26. If the stanchion assemblies 22 are of the construction designated the second alternate embodiment 22'', the bases 52 will already be secured to the surface assembly 20. In this case, after the surface assembly 20 has been secured to the highway 14, the vertical members 44' may be quickly installed by means of the bayonet assemblies 54 previously described. Removal of the lane delineator 10 may be effected by following the appropriate above steps in the reverse order.

Once in place, the lane delineator 10 provides a highly visible barrier, a physical barrier, and a barrier which creates audible sound when driven upon by a moving vehicle. As noted previously, the vertical oscillation created by traverse of a vehicle tire over the tabs 26 and open regions 28 produces a vibration which is both physically sensible to the driver of the vehicle through the steering system and audible. This vibration increases in intensity as the vehicle encroaches further upon the surface assembly 20. Should the vehicle traverse the lane delineator 10 to its mid-section and encounter the stanchion assemblies 22, a significantly greater sound level will be generated. If the surface assembly 20 is of the structure illustrated in the alternate embodiment 20', the angularly disposed leading edges 62 of the surface assembly 20 will assist in redirecting the tires and thus the vehicle to the right and away from the lane delineator 10.

The foregoing disclosure is the best mode devised by the inventor for practicing this invention. It is apparent, however, that apparatus incorporating modifications and variations will be obvious to one skilled in the art of roadway markers. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. A moveable traffic lane delineator for use on a vehicle pathway surface comprising, in combination, an elongate, flexible assembly for disposition on such pathway surface having substantially planar and parallel upper and lower surfaces, said assembly including a central portion having a plurality of spaced-apart apertures and a plurality of spaced-apart tabs extending from both edges of said central portion, said tabs having an upper surface coplanar with said upper surface of said assembly and having a width approximately equal to the distance between an adjacent pair of tabs and including fastener means for securing said tabs to said surface, and a plurality of upright dividers disposed on said central portion for visually marking the edge of the traffic lane said upright dividers including a cylindrical member, a flanged base and means for flexibly interconnecting said base and said member, said flange having a diameter greater than the diameter of said apertures whereby vehicles moving over said tabs produce an audible warning.

2. The traffic lane delineator of claim 1 wherein said upright dividers further include a means associated with said cylindrical member and said flanged base for selectively interconnecting said member and said base.

3. The traffic lane delineator of claim 1 wherein said tabs have substantially parallel front and rear edges.

4. The traffic lane delineator of claim 1 wherein said tabs define parallelograms.

5. The traffic lane delineator of claim 1 wherein said tabs have at least one edge oriented at a small acute angle to the transverse axis of said elongate planar assembly.

6. The traffic lane delineator of claim 1 wherein said tabs include at least one edge having reflective material disposed thereon.

7. A traffic lane delineator for placement on the surface of a vehicle pathway comprising, in combination, an elongate, flexible planar assembly for disposition on such surface, said assembly including a base portion having substantially planar upper and lower surfaces and a plurality of spaced-apart tabs extending from at least one edge of said base portion for providing an audible warning to vehicles moving thereover, said tabs having an upper surface coplanar with said upper surface of said base portion, means for securing said tabs on the surface of such vehicle pathway, and a plurality of spaced-apart vertically oriented dividers disposed generally medially along said base portion, said dividers including a cylindrical member, a mounting base associated with each said cylindrical member and means for selectively securing such dividers to said base portion.

8. The traffic lane delineator of claim 7 when said base portion includes tabs on both edges thereof and said tab width is approximately equal to the spacing between adjacent ones of said spaced-apart tabs.

9. The traffic lane delineator of claim 7 wherein said tabs have substantially parallel front and rear edges.

10. The traffic lane delineator of claim 7 wherein said tabs define parallelograms.

11. The traffic lane delineator of claim 7 wherein said tabs are disposed at a small acute angle to the transverse axis of said base portion and said tabs include at least one edge having light reflective material disposed thereon.

12. The traffic lane delineator of claim 7 wherein said base portion includes spaced-apart apertures disposed generally medially there along for receiving said cylindrical members of said dividers.

13. The traffic lane delineator of claim 7 wherein said vertically oriented dividers includes resilient means for maintaining said cylindrical member in a substantially vertical orientation.

* * * * *